United States Patent [19]

Egerström et al.

[11] 4,051,988

[45] Oct. 4, 1977

[54] TUBE FEEDING DEVICE FOR USE IN CHARGING SHOTHOLES WITH EXPLOSIVE THROUGH A PIPE OR TUBE

[75] Inventors: Bengt Gunnar Wilhelm Egerström, Danderyd; Bror Lennart Teodor Sternhoff, Stockholm, both of Sweden

[73] Assignee: Nitro Nobel AB, Gyttorp, Sweden

[21] Appl. No.: 714,193

[22] Filed: Aug. 13, 1976

[30] Foreign Application Priority Data

Aug. 19, 1975 Sweden ..... 7509262

[51] Int. Cl.[2] ..... B65H 17/38

[52] U.S. Cl. ..... 226/162; 166/77; 86/20 C

[58] Field of Search ..... 86/20 C; 166/77, 75; 226/162, 150, 158, 161, 112, 95

[56] References Cited

U.S. PATENT DOCUMENTS

| | | | |
|---|---|---|---|
| 2,389,556 | 11/1945 | Siegerist | 226/112 UX |
| 3,010,568 | 11/1961 | Annegarn | 226/150 X |
| 3,131,776 | 5/1964 | Kvello-Aune et al. | 166/77 UX |
| 3,133,469 | 5/1964 | Ljungberg | 86/20 C |
| 3,474,946 | 10/1969 | Desplats et al. | 226/162 X |
| 3,665,887 | 5/1972 | Worthing | 166/77 X |
| 3,797,570 | 3/1974 | Leutwyler | 166/77 |
| 3,819,073 | 6/1974 | Asselborn et al. | 226/112 X |
| 3,854,645 | 12/1974 | Knights | 226/162 |

*Primary Examiner*—David H. Brown

*Attorney, Agent, or Firm*—Shlesinger, Fitzsimmons & Shlesinger

[57] ABSTRACT

The apparatus includes two clamping devices mounted for vertical reciprocation one above the other, and having registering central apertures through which a flexible tube is adapted to be advanced. Each clamp contains a flexible sleeve disposed to surround the tube and selectively to be pressed into gripping engagement with it by means of a fluid pressure medium. This medium is also used to reciprocate the clamps alternately toward and away from each other, with only one clamp at a time being actuated so that the tube is advanced (e.g. fed upwardly) first by one and the other of the clamps.

7 Claims, 3 Drawing Figures

TUBE FEEDING DEVICE FOR USE IN CHARGING SHOTHOLES WITH EXPLOSIVE THROUGH A PIPE OR TUBE

This invention relates to a tube feeding device for the charging of shotholes with explosive through a tube or pipe incorporating the use of a clamping device, consisting of a tank with one wall of flexible material with the clamping device connected to the movable part of a cylinder and a piston-operated servomotor installed therein, the container being arranged so that it is periodically pressurized using a pressure medium source and a valve system, the tube only being moved by the clamping device in one of the directions of the movable part's reciprocating motion dependent on the pressure medium being fed to one side or the other of the piston through the valve system.

A feeding device, which is in principle constructed following the concept outlined above, is described in Swedish Patent No. 208,136. The arrangement works in such a way that the movable clamping device grips the pipe or tube and feeds the same in one of the directions of the movable part's motion. A stationary clamping device is used to hold the tube while the movable clamping device moves in the opposite direction driven by the movable part. The tube is then gripped once more by the movable clamping device and a new tube feeding movement starts. Consequently the tube feeding takes place in stages with clearly defined intervals between each stage.

The main purpose of this invention is to create a feeding arrangement which allows the tube to be fed through considerably faster without loss of clamping capacity. This is made possible by a feeding device of the type mentioned in the preamble which according to the invention is principally characterized by the fact that it incorporates at least an extra, second clamping device with the respective servomotor plus the fact that both clamping devices are arranged so that in principle they move simultaneously alternatively towards and away from each other, although in such a way that they feed the tube in the same direction, one clamping device in operation feeding the tube through even during the period when the other clamping device not in use is moving contra to the direction in which the tube is being fed.

Therefore the use of two moving parts instead of one moving and one stationary part can considerably increase the feeding speed compared to the feeding speed of the known construction. Despite this still only two clamping devices are required.

According to the invention both clamping devices and their servomotors are disposed between two end frames which are provided with two tube holes, to which the device's valve units are also attached. A further tube guiding device is situated between the frame ends so that the tube is fed through the tube holes in the frame ends and the tube guiding device, which can consist of a cylindrical guide ring, for example. This form of construction results in a unitary and compact feeding device, whose total length insignificantly exceeds the sum of the length of the stroke of the two moving parts.

The invention is described in more detail below with reference to the embodiment shown on the accompanying drawings, wherein.

The same parts which appear in different figures have been given the same reference designation.

Figure 1:
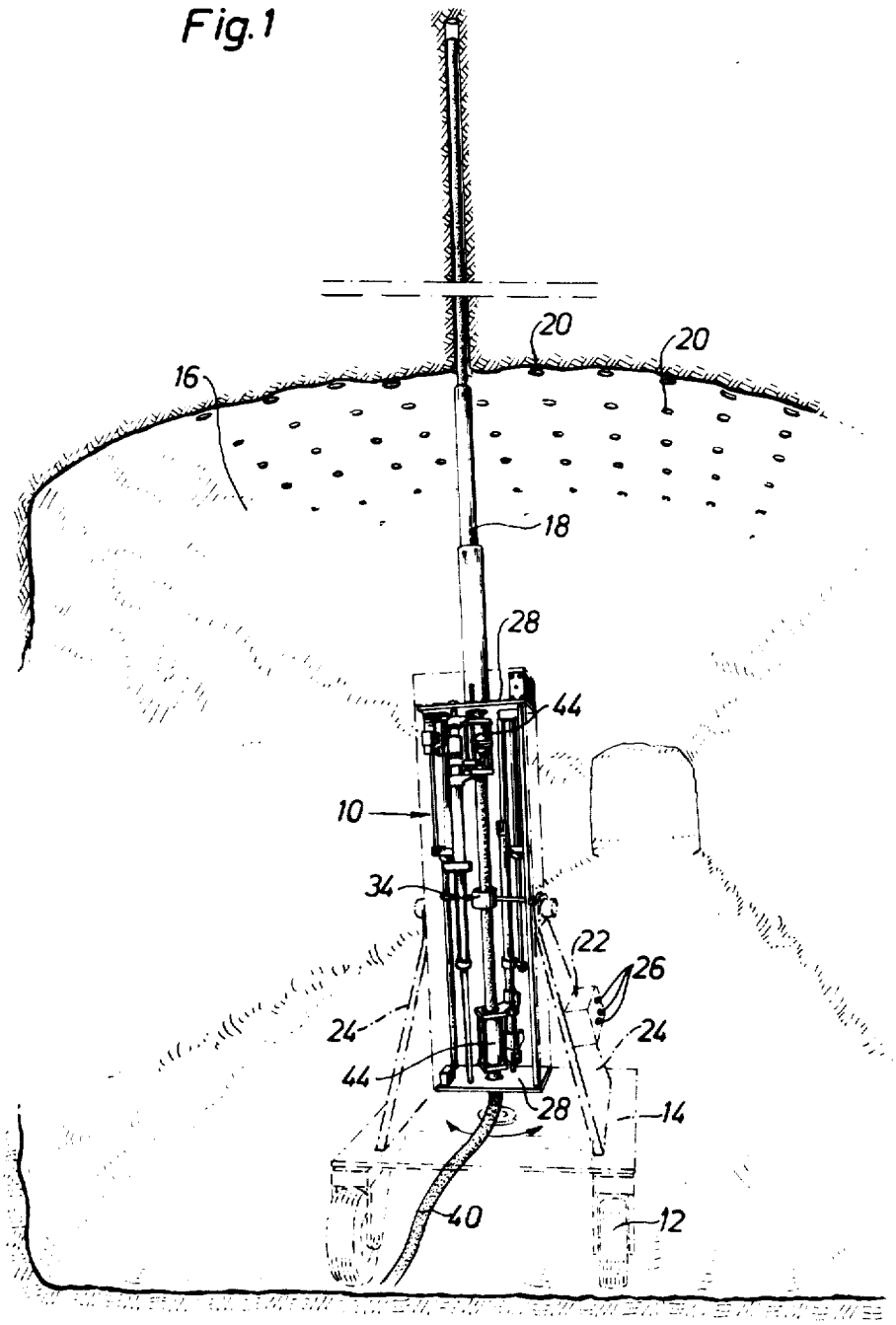
FIG. 1 is a perspective view of the new feeding device in use in a rock chamber and mounted on a transportable trolley shown in phantom by broken lines.

The new tube feeding device 10 can, for example, be set on a trolley 14 mounted on wheels 12, as shown in FIG. 1. The trolley 14 is moved to the required position in a rock chamber 16 and the feeding section 18 of the device is lined up with one of the shotholes 20 in the rock chamber 16. In this respect the feeding device 10 can be conveniently rotated relative to the trolley 14 (see arrows in FIG. 1) so that it can be lined up quickly and accurately with the shotholes 20. The feeding of the tube is governed from a control panel 22 mounted on the trolley's frame or on one of the tube feeding device's mounting units 24. The panel 22 has at least stop and start controls for the device plus controls for governing the direction of feed.

The tube feeding device 10 shown in the drawing comprises two frame ends 28 which are individually mounted on four frame tubes 30, 32. The two outer frame tubes 30 are principally intended to act as stabilizing spacers for plates 28 and as mounting units for the tube guiding device which incorporates a cross member 36, holding a guide ring 34, placed between the frame ends 28. The guide ring 34 is situated in line with the apertures 38 in the frame ends 28 so that the feeder tube 40 can travel in a straight line through the tube holes 38 and the guide ring 34. The guide ring is intended to provide support for the tube 40 so that it does not bulge outwardly nor fold inwardly while being fed through the feeding device 10.

Figure 3:
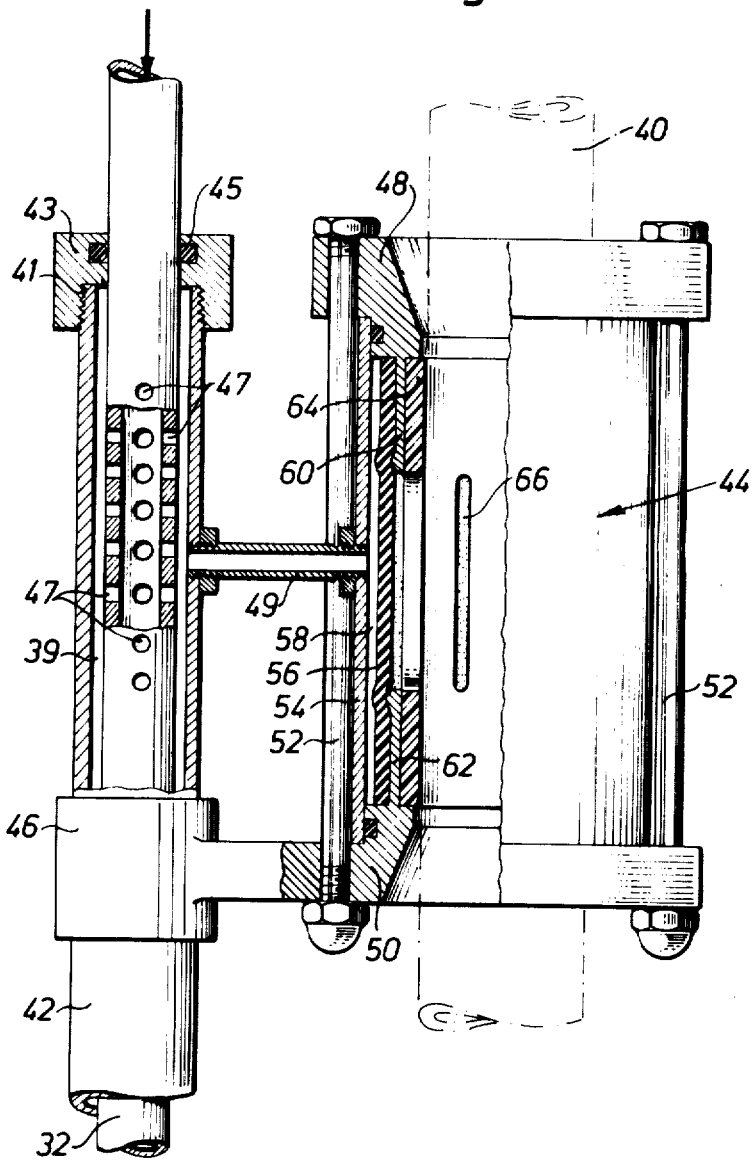
FIG. 3 is an enlarged detail view of part of the device shown in FIG. 2, and illustrating fragmentarily and in section the novel clamping device incorporated in the new feeding device and the supply lines for its pressure medium.

The two inner frame tubes 32 also act as spacers and stabilizing units for the feeding device 10. In addition they are both surrounded by sleeves 42 arranged in such a way, as shown in FIG. 3, that they surround each frame tube 32 with a clearance 39 and are provided with seals at the ends allowing the sleeves to slide easily along each of the frame tubes 32. Each end seal comprises a collar 43 threaded as at 41 to the ends of each sleeve, plus an integrated sealing ring 45. In addition a clamping device, denoted generally at 44, is attached to one end section of each sleeve 42 by two clamps 46 (only one of which is shown in FIG. 3) in such a way that the feeder tube 40 runs through the clamping device 44.

The clamping device shown in FIG. 3 is seen in the lowest position it reaches during its travel, the tube 40 being represented by the broken lines. The clamping device 44 comprises two ends 48, 50, which are mounted on four connecting bolts 52, of which only two are shown in FIG. 3. The ends 48, 50 form the end walls of a container comprising an outer, cylindrical jacket 54 and internal sleeve 56, preferably made of rubber. Consequently there is a cylindrically-shaped space 58 between the outer jacket 54 and the sleeve 56. When the pressure medium, from a pressure medium source (not shown), is introduced into the space 58 through the frame tube 32, the holes 47 drilled in each tube 32, plus a supply pipe 49 which connects the spaces 39 and 58, the flexible sleeve 56 bows inwardly. The inside of the ends of the sleeve 56 surround circular flanges 60 and 62, which project coaxially from the ends 48, 50. A slotted liner 64, comprising a cylinder with slots 66, is situated radially inside the inner sleeve 56 and has opposite ends thereof extending coaxially into flanges 60 and 62. The cylinder material is selected so that it provides the requisite friction when pressure is applied to the tube 40 without appreciable wear occurring against the tube 40 due to repeated changes of pressure in the container. When pressure in the said space 58 causes the sleeve 56 to bend inwardly, it acts on the slotted liner 64, which consequently bends inwardly resulting in the tube 40 in the clamping device 44 being gripped and held by cylinder 64.

Figure 2:
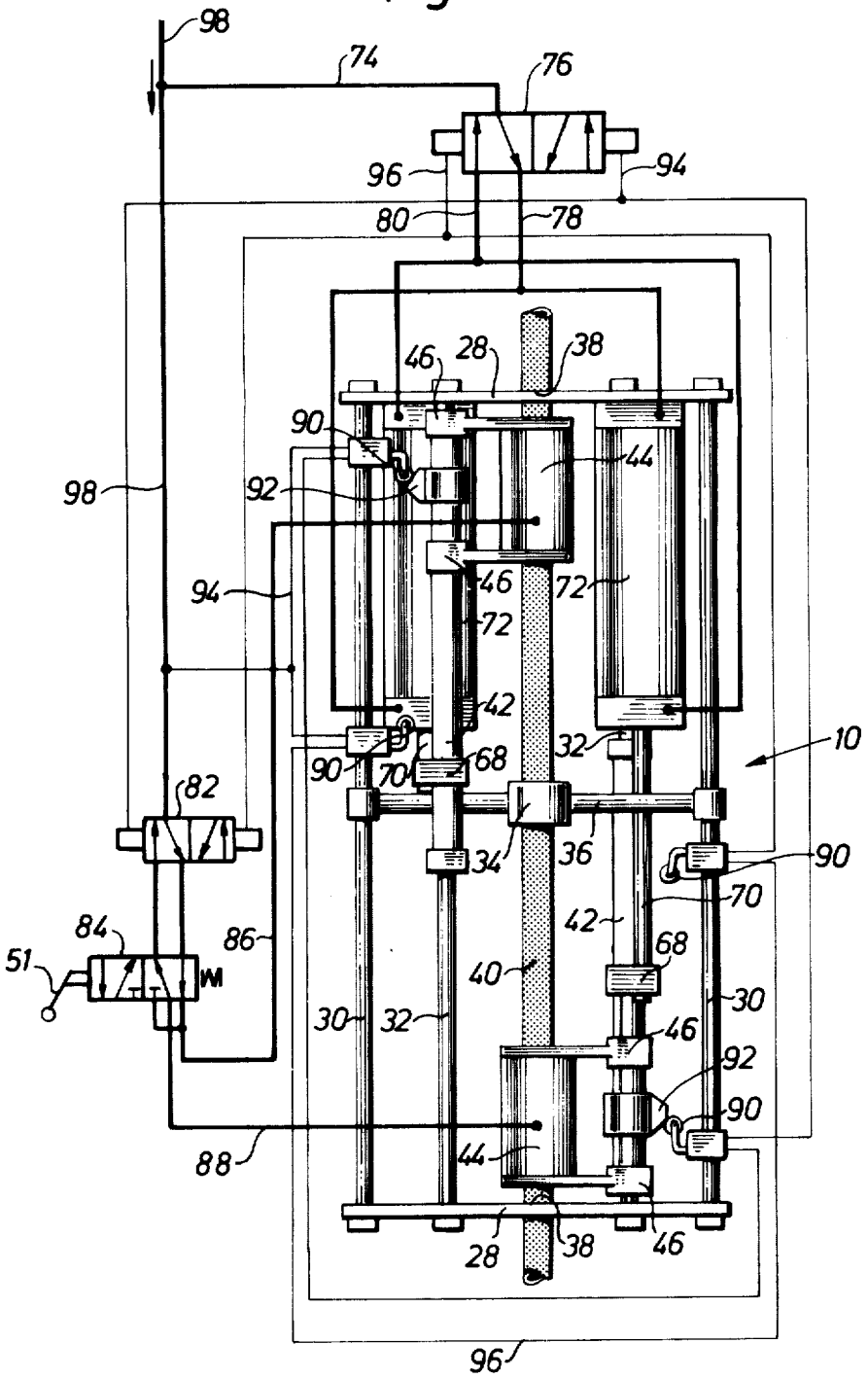
FIG. 2 is an outline of the basic arrangement of the device, diagrammatically showing the new feeding device and its control system.

Each sleeve 42 is rigidly connected by a connecting piece 68 to a reciprocable connecting rod 70 (FIG. 2) and its attached piston (not shown). Each piston reciprocates in one of two cylinders 72 which are rigidly mounted on one of the frame ends 28. Each piston and its corresponding cylinder 72 form a servomotor which is driven by a pressure medium which passes through the pressure medium pipe 74, the valve unit 76 and the pipes 78 and 80 into opposite ends of cylinders 72 where it acts selectively on both sides of the respective piston.

Two more valve units 82, 84 (FIG. 2) are incorporated into the feeding device 10 and enable the supply of pressure medium selectively to both clamping devices 44 through the pipes 86, 88. The feed is only shown diagrammatically in FIG. 2. As can be seen from this figure an exciter or actuator is placed at each end of the reciprocable path of travel of each sleeve 42. Movement of the sleeves 42 activates the respective exciters 90, and this connects the regulating valves 76, 82 for the introduction of the pressure medium. Each sleeve 42 is provided with a projection 92 to activate the exciters 90. In the embodiment shown the exciters 90 are connected in series by pairs. Wiring for the exciters is shown in the figure with the reference designation 94, 96.

It should be noted that both clamping units 44 are arranged for alternate operation, and for simultaneous movement, alternating towards and away from each other. At the point where the distance between them is shortest they are situated immediately against the guide ring 34. At the point where the distance between them is greatest they are situated immediately against their respective frame ends (FIG. 1). The tube is fed forward (e.g. upwardly in FIG. 1) by one of the clamping devices, the one then in operation, for the majority of the period that the other or inoperative clamping device is moving against the direction of the tube feed. Valve 84 is a reversing valve which is used to change the direction of the tube feed by manual operation of the lever 51.

Assuming that both clamping devices 44 are situated immediately against the guide ring 34 as a starting position, the tube is fed forward according to the following sequence: The upper clamping device 44 receives pressure medium from a pressure medium source (not shown) through the pipes 98, 86 and the valves 82, 84 and grips the tube 40 at the same time as the lower section of the cylinder 72 shown on the left (FIG. 2) and the upper section of the cylinder 72 shown on the right (FIG. 2) are fed with the pressure medium through pipes 98, 74, 78 and the valve 76. At this point the lower clamping device 44 is not under pressure. The clamping devices 44 are simultaneously forced apart by the action of the pistons which have been activated by the pressure in the cylinders 72. The outer exciters 90 are then activated by their respective projections 92 when the clamping devices reach their outer positions, with the result that the valves 76 and 82 are set into operation through the exciter wiring 94, stopping the movement of both clamping devices 44. At the same time the container of lower clamping device 44 is put under pressure through pipes 98, the valves 82, 84 plus the pipe 88, while the upper clamping device's container is evacuated possibly through a rapid discharge valve (not shown). The clamping devices 44 are now forced towards each other by simultaneously feeding pressure medium into the upper section of the cylinder 72 on the left and the lower section of the cylinder 72 on the right through the pipes 98, 74 and 80 plus the valve unit 76, causing the lower clamping unit 44 to advance the tube. The respective inner exciters 90 in the vicinity of the guide ring 34 are activated by their respective projections 92 which results in cessation of the movement of the clamping devices 44 due to the valve units being activated through the exciter's wiring 96 and the upper clamping device 44 being put under pressure again, while the lower clamping device 44 is evacuated. The process is then repeated, the upper clamping device 44 again feeding the tube 40 with its upward movement.

Modifications of the feeding device 10 described above are possible and within the scope of the invention. For example a third clamping device could be arranged equipped with a separate servomotor and designed to feed tube in the intended direction during pauses in the first and second clamping device's feeding movements. Moreover, while in FIG. 2 the wiring 94 is shown connected to pipe 98, obviously this is illustrated merely by way of example to indicate that instead of operating the valves 76 and 82 electrically by solenoids, they could be controlled by pilot valves, or the like, operated by the fluid pressure medium which supplies pipe 98.

Having thus described my invention, what I claim is:

1. A device for feeding a tube into and out of a shothole for use in charging the shothole with an explosive, comprising a pair of clamping devices each having therethrough an axial bore through which a tube is adapted to be advanced, means guiding said clamping devices for reciprocable movement in a common path, and with their axial bores aligned coaxially of one another so that said tube may extend coaxially through both of said bores during the feeding thereof, each of said clamping devices including a fluid pressure-operated wall of flexible material forming the axial bore through the device, and disposed selectively to grip the tube extending through said bore, a pair of parallel cylinders each having a reciprocable piston rod operatively connected to one of said clamping devices to impart reciprocation thereto, means for connecting said cylinders to a supply of fluid under pressure, and operative to cause said fluid to impart reciprocation to said piston rods simultaneously to move said clamping devices alternately towards and away from each other, means including said guiding means for selectively and intermittently connecting said clamping devices to said fluid supply, when said devices are in one of their limit positions, and operative to convey fluid under pressure from said supply to the flexible walls in said clamping devices thereby to cause said walls momentarily to collapse radially inwardly and one at a time into gripping engagement with the tube extending through said bores, whereby during the period when one of said clamping devices is in gripping engagement with said tube the other clamping device will not be in operation, and will be moving in a direction opposite to that in which the tube is being fed, and means for selectively changing the feeding direction of said tube by changing the mutual gripping sequences of said clamping devices.

2. A device according to claim 1, including means mounting adjacent each end of each path of travel of said clamping devices an exciter which is positioned to be operated each time one of said clamping devices reaches one of its limit positions, and means responsive to the operation of each exciter to reverse the direction of flow of the fluid under pressure to the cylinder which imparts motion to the particular clamping device associated with the last-named exciter.

3. A device according to claim 1, wherein both said clamping devices and said cylinders are housed between two protective frame ends extending transverse to the bores in said clamping devices and equipped with tube holes which register with the bores in said clamping devices, and through which the tube is fed.

4. A device according to claim 3, wherein a tube guiding device is positioned between said clamping devices and in registry with said bores so that the tube is fed through the tube holes in the frame ends and the tube guiding device.

5. A device according to claim 1, wherein each of said clamping devices comprises a flexible sleeve arranged between two end pieces and inside of an outer, rigid jacket, and means connecting a cylindrical space between said sleeve and said jacket with said fluid pressure means selectively to convey fluid under pressure to said space.

6. A device according to claim 5, wherein a tubular, flexible liner having therein axially extending slots is arranged between said end pieces and inside said sleeve to be urged by the latter into gripping engagement with said tube when fluid under pressure is supplied to said space.

7. A device according to claim 5, wherein said guiding means comprises a pair of tubular members each of which supports one of said clamping devices for reciprocation between said two end pieces, said means for connecting said clamping devices to said fluid supply further includes valve means for selectively connecting the bore in each of said tubular members with said fluid supply means, and means for conveying fluid under pressure from the bores in said tubular members and through a plurality of openings in the walls thereof, to said cylindrical spaces in said clamping devices, when the latter are in one of their limit positions.

* * * * *